US005864327A

United States Patent [19]

Kokuhata et al.

[11] Patent Number: 5,864,327

[45] Date of Patent: Jan. 26, 1999

[54] METHOD OF DRIVING LIQUID CRYSTAL DISPLAY DEVICE AND LIQUID CRYSTAL DISPLAY DEVICE

[75] Inventors: Yoshiyuki Kokuhata, Nara; Takeshi Seike, Kitakatsuragi-gun, both of Japan

[73] Assignee: Sharp Kabushiki Kaisha, Osaka, Japan

[21] Appl. No.: 627,421

[22] Filed: Apr. 4, 1996

[30] Foreign Application Priority Data

Apr. 25, 1995 [JP] Japan ..... 7-101398

[51] Int. Cl.[6] ..... G09G 3/36

[52] U.S. Cl. ..... 345/90; 345/95; 345/96

[58] Field of Search ..... 345/90–92, 94–97, 345/98, 100, 214; 349/34, 37, 49, 50

[56] References Cited

U.S. PATENT DOCUMENTS

| | | | |
|---|---|---|---|
| 4,386,352 | 5/1983 | Nonomura et al. | 345/96 |
| 4,945,352 | 7/1990 | Ejiri | 345/96 |
| 5,032,831 | 7/1991 | Kuijk | 345/91 |
| 5,459,481 | 10/1995 | Tanaka et al. | 345/95 |
| 5,526,013 | 6/1996 | Ono et al. | 345/94 |
| 5,561,441 | 10/1996 | Hamano | 345/91 |

FOREIGN PATENT DOCUMENTS

| | | |
|---|---|---|
| 68712/1993 | 9/1992 | Japan . |
| 323385/1993 | 7/1993 | Japan . |

*Primary Examiner*—Chanh Nguyen
*Attorney, Agent, or Firm*—Nixon & Vanderhye, P.C.

[57] ABSTRACT

In a method for driving a liquid crystal display device in which a scanning electrode signal and a data electrode signal are successively applied to a display panel where picture elements, which are arranged so that a liquid crystal element and a two-terminal non-linear element are connected in series, are arranged in a matrix-like pattern, a scanning electrode signal whose level is switched to a higher and lower levels than a reference level is applied during the selecting period for determining as to whether the picture element is turned on or off and a scanning electrode signal with the reference level is applied during non-selecting period. As a result, production of a residual image and occurrence of crosstalk can be lowered.

7 Claims, 16 Drawing Sheets

SELECTING PERIOD
SELECTING PERIOD
LP

M

Vo
Voa
Vob

V5
Vo
Vo'

VM2
V5
V5'
Vo
Voa
Vob

VM2
Vob
Voa

SELECTING PERIOD
SELECTING PERIOD
LP

M

Vo

VM2
V5
-Vo
Vo

VM2
-Vo

SELECTING PERIOD
SELECTING PERIOD
LP

M
V0
V1

V2
V3
V4
V5(GND)
V0
V1

V2
V3
V4
V5 (GND)
V0

GND
-V0

METHOD OF DRIVING LIQUID CRYSTAL DISPLAY DEVICE AND LIQUID CRYSTAL DISPLAY DEVICE

FIELD OF THE INVENTION

The present invention relates to a method for driving a liquid crystal display device provided with a display panel where picture elements with a constitution that liquid crystal elements and two-terminal non-linear elements are connected in series are arranged in a matrix-like pattern.

BACKGROUND OF THE INVENTION

In recent years, a liquid crystal display device is employed in products in various fields including AV (Audio and Visual) and OA (Office Automation). Low-end products are equipped with a passive matrix-type liquid crystal display device of TN (Twisted Nematic) or STN (Super Twisted Nematic), and high-end products are equipped with a liquid crystal display device adopting an active matrix driving method where TFT (Thin Film Transistor), which is a three-terminal non-linear element, is used as a switching element.

A liquid crystal display device adopting an active matrix driving method is superior in color reproducibility, thinness, lightness, and low power consumption to CRT (Cathode Ray Tube), so uses of such a liquid crystal display device rapidly spread. However, in the case where TFT is used as a switching element, in its producing process, it is necessary to repeat a thin film forming process and a photolithography process not less than 6 to 8 times, so the cost rises. For this reason, it is a most serious problem to lower the cost of production.

On the contrary, a liquid crystal display device where a two-terminal non-linear element is used as a switching element is superior in cost to a liquid crystal display device using TFT, and is also superior in display quality to a passive matrix-type liquid crystal display device. For this reason, a market for the liquid crystal display device using a two-terminal non-linear element is greatly expanded.

As shown in FIG. 11, a liquid crystal display device using a two-terminal non-linear element is composed of a display panel 112, a scanning electrode signal driver 113 for applying a fixed voltage to a scanning electrode line of the display panel 112 line-sequentially, a data electrode signal driver 114 for applying a fixed voltage to a data electrode line according to displayed information, and a control section 111 for transmitting a control signal respectively to the scanning electrode signal driver 113 and the data electrode signal driver 114 in order to display inputted information from an input signal line 115.

As shown in FIG. 12, the display panel 112 is arranged so that picture elements are placed in a matrix-like pattern, and each picture element is arranged so that a liquid crystal element 125 and a two-terminal non-linear element 126 are connected in series across each scanning electrode line (Y1 through Ym) and each data electrode line (X1 through Xn).

The scanning electrode signal driver 113 is composed of a liquid crystal driving power generating circuit, a shift register, an analog switch, etc., and the data electrode signal driver 114 is composed of a shift register, a latch circuit, an analog switch, etc. (not shown).

In the above arrangement, as shown in FIGS. 13(*a*) through 13(*e*), a fixed voltage (one of the six levels of liquid crystal driving voltages V0 through V5) is applied respectively from the scanning electrode signal driver 113 and the data electrode signal driver 114 to the scanning electrode lines (Y1 through Ym) and the data electrode lines (X1 through Xn) based upon a latch pulse (LP) of FIG. 13(*a*) and a switching signal (M) of FIG. 13(*b*). For example, in the case where voltages represented by waveforms in FIGS. 13(*c*) and 13(*d*) are applied to Y1 and X1, a voltage represented by a waveform in FIG. 13(*e*) is applied to both ends of a picture element connected to Y1 and X1. When a voltage represented by a solid line is applied, the liquid crystal element 125 is turned on, and when a voltage represented by a dotted line is applied, the liquid crystal element 125 is turned off.

As shown in FIG. 14, the two-terminal non-linear element 126 is characterized in that its equivalent resistance becomes smaller as the level of an applied voltage (V) becomes higher. Namely, as the level of the applied voltage becomes higher, the level of a current (I) becomes abruptly higher. A curved line 141 in the drawing shows an initial I-V characteristic, and when a voltage is continued to be applied, the I-V characteristic is shifted as shown by a curved line 142. The I-V characteristic is approximately symmetric with respect to the origin. Therefore, description of the case where a negative voltage is applied is omitted.

Since the two-terminal non-linear element 126 has the above I-V characteristic, a voltage applied to the picture element during selecting period (during period of display on picture elements) is held even during the non-selecting period. As a result, an active matrix-type liquid crystal display device using the two-terminal non-linear element 126 can be driven at higher duty compared to a simple matrix-type liquid crystal display device.

Furthermore, an active matrix-type liquid crystal display device can be driven by using a voltage averaging method for applying a voltage of FIG. 15 to a picture element like a simple matrix-type liquid crystal display device. In the voltage averaging method, in the case where the liquid crystal element 125 is turned on, a voltage represented by a solid line 151 is applied, and in the case where the liquid crystal element 125 is turned off, a voltage represented by a dotted line 152 is applied. In other words, the liquid crystal element 152 is turned on or off according to the level of the applied voltage during the selecting period. When a DC component is stored in the liquid crystal element 125, reliability is lowered. In order to avoid this, in general, alternating current is applied per frame (or per plural frames, or per plural lines) so that polarity of the applied voltage is reversed.

The active matrix-type liquid crystal display device using the two-terminal non-linear element 126 can realize high contrast and uniform display using the voltage averaging method.

However, in accordance with the above conventional arrangement, there arises a problem that a residual image (burning) is liable to be produced. For example, in a liquid crystal display device in normally white mode (in this mode, black is displayed when the liquid crystal element 125 is turned on), as shown in FIG. 16(*a*), a pattern composed of a white center portion P1 and a black peripheral portion P2 is displayed on the display panel 112, and the pattern is changed so that the whole screen becomes gray which is half tone. Then, as shown in FIG. 16(*b*), a part of the pattern which was previously displayed remains, so the whole screen does not become uniform. In other words, there is a difference in display between the white center portion P1 and the black peripheral portion P2, and thus a residual image is produced.

The residual image is caused by a shift in a voltage-dependent I-V characteristic in the two-terminal non-linear element 126. In other words, when the voltage is continued to be applied to the non-linear element 126, as mentioned above, the I-V characteristic is shifted from the curved line 141 to the curved line 142 (see FIG. 14). Accordingly, a T-V (transmittance-voltage) characteristic of the liquid crystal element 125 is also shifted from a curved line 171 to a curved line 172 as shown in FIG. 17. For example, a voltage whose transmittance is 50% is shifted from $V_{50}$ to $V_{50'}$ in the drawing.

As shown in FIG. 18, a shift amount of the voltage $\Delta V$ ($=V_{50'}-V_{50}$) changes according to voltage applying time. Moreover, when the level of the applied voltage becomes higher, a shift amount $\Delta V$ becomes larger. In the drawing a curved line 181 shows a shift amount $\Delta V$ when a higher voltage than a curved line 182 is applied.

As a result, when the pattern of FIG. 16(*a*) is displayed, a shift amount $\Delta V$ of the peripheral portion P2 to which a higher voltage is applied is larger compared with the central portion P1. Then, when the pattern is changed so that the whole screen becomes grey which is half tone, namely, so that a voltage with the same level is respectively applied to the central portion P1 and the peripheral portion P2, the transmittance of the peripheral portion P2 becomes higher compared with the central portion P1 (FIG. 17). Therefore, the residual image is produced as shown in FIG. 16(*b*).

In order to suppress the production of such a residual image, in Japanese Examined Patent Publication No. 5-68712 (Tokukohei 5-68712), selecting period is divided into two, and adjustment charges, which makes it possible to ignore initial charge dependency of the non-linear element, are injected into an electro-optical element, such as a liquid crystal element, through a non-linear element during the first half of the period, and charges according to display data are injected into the electro-optical element through the non-linear element during the latter half of the period. As a result, an image is displayed without depending on previous display.

In addition, in Japanese Unexamined Patent Publication No. 5-323385/1993 (Tokukaiehei 5-323385), polarity of a voltage to be applied during the first half of the period is opposite to a polarity of a voltage to be applied according to the display data during the latter half of the period. A polarization amount of an MIM (metal-insulator metal) element as the non-linear element is made constant by sufficiently heightening the level of the voltage to be applied during the first half of the period so that the polarization amount does not depend on turning ON/OFF of the liquid crystal element. As a result, an image is displayed without depending on previous display.

However, the above driving method lowers production of a residual image, but it is difficult to use the driving method in the scanning electrode signal driver 113 and the data electrode signal driver 114 for driving picture element through the voltage averaging method.

In other words, as shown in FIGS. 19(*a*) through 19(*e*), in the case where a scanning electrode signal (FIG. 19(*c*)) and a data electrode signal (FIG. 19(*d*)) are created by making a selection from the liquid crystal driving voltages V0 through V5 according to a switching signal M, a driving voltage to be applied to a picture element becomes an ON voltage (shown by a solid line in FIG. 19(*e*)) or an OFF voltage (shown by a dotted line in FIG. 19(*e*)). For this reason, it is difficult to control a level of a driving voltage during the selecting period.

In addition, since the polarity of the scanning electrode signal with higher level and the data electrode signal with higher level is changed, crosstalk is liable to be generated during the non-selecting period.

SUMMARY OF THE INVENTION

It is an object of the present invention to provide an easily realizable method for driving a liquid crystal display device which is capable of lowering production of a residual image in a liquid crystal display device.

In order to achieve the above object, a method for driving a liquid crystal display device, in which a scanning electrode signal and a data electrode signal are successively applied to a display panel where picture elements, which are arranged so that a liquid crystal element and a two-terminal non-linear element are connected in series, are arranged in a matrix-like pattern so that the display panel is driven by a voltage averaging method, is characterized by having the steps of applying a scanning electrode signal whose level is switched between lower and higher level than a reference level during selecting period for determining as to whether the picture element is turned on or off, and applying a scanning electrode signal with the reference level during non-selecting period.

In accordance with the above arrangement, since the scanning electrode signals with different levels are applied during the selecting period, a shift amount of an I-V characteristic of the two-terminal non-linear element connected to the liquid crystal element in ON-state can be made substantially equal to a shift amount of an I-V characteristic of the two-terminal non-linear element connected to the liquid crystal element in OFF-state by adjusting the levels. As a result, production of a residual image due to the shift of the I-V characteristic can be lowered. Moreover, since the scanning electrode signal with the reference level is applied (the scanning electrode signal with constant level is applied), polarity of the scanning electrode signal is not reversed during the non-selecting period, and the level of the data electrode signal can be lowered. As a result, since a fluctuation in the voltage to be applied to the picture element during the non-selecting period can be made small, occurrence of crosstalk can be lowered.

For fuller understanding of the nature and advantages of the invention, reference should be made to the ensuing detailed description taken in conjunction with the accompanying drawings.

BRIEF DESCRIPTION OF THE DRAWINGS

FIG. 10(*a*) is a schematic connecting diagram between a driver and an external power source; and FIG. 10(*b*) is a block diagram which shows an internal arrangement of the driver.

FIG. 16(*a*) shows an original image; and FIG. 16(*b*) shows an image on which a residual image is produced.

DETAILED DESCRIPTION OF THE PREFERRED EMBODIMENT

The following describes one embodiment of the present invention on referring to FIGS. 1 through 10.

Figure 1:
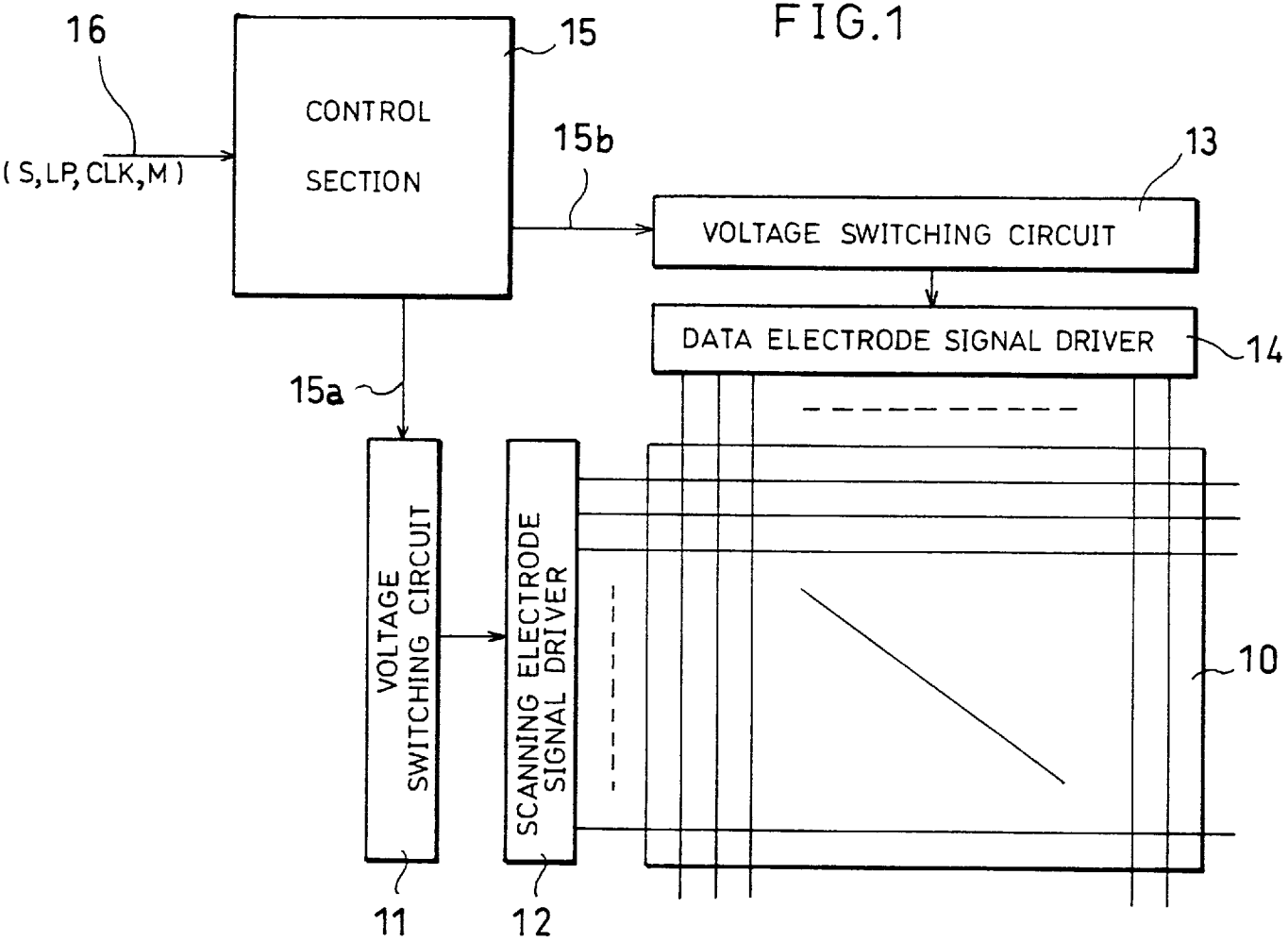
FIG. 1 is a block diagram which shows a schematic arrangement of a liquid crystal display device of the present invention.

As shown in FIG. 1, a liquid crystal display device of the present embodiment is composed of a display panel 10, a scanning electrode signal driver 12 for line-sequentially applying a driving voltage to a scanning electrode line of the display panel 10, a voltage switching circuit 11 for creating a driving voltage for driving the scanning electrode so as to transmit it to the driver 12, a data electrode signal driver 14 for line-sequentially applying a driving voltage to a data electrode line of the display panel 10, a voltage switching circuit 13 for creating a driving voltage for driving the data electrode so as to transmit it to the driver 14, and a control section 15 for transmitting a control signal 15*a* to the voltage switching circuit 11 and transmitting a control signal 15*b* to the voltage switching circuit 13 so as to display inputted information based upon a control signal 16. The control signal 16 includes a scanning start signal (S), a latch pulse (LP), a clock (CLK), a switching signal (M).

Figure 12:
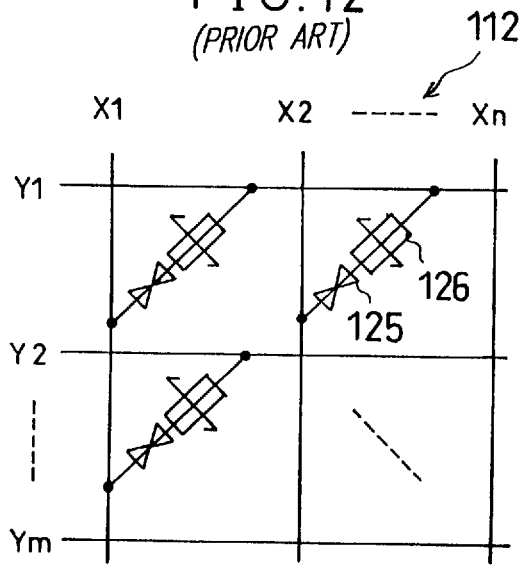
FIG.12 (PRIOR ART)
FIG. 12 is a circuit diagram which shows an arrangement of a picture element in the liquid crystal display device of FIG. 11.

The display panel 10 is composed so that picture elements are arranged in a matrix-like pattern. Each picture element is arranged so that a liquid crystal element and a two-terminal non-linear element are connected in series across each scanning electrode line and each signal electrode line (namely, has the same arrangement as that in FIG. 12 of a prior art).

The scanning electrode signal driver 12 is composed of a control section, a shift register, an analog switch, etc. like a prior art. The data electrode signal driver 14 is also composed of a control section, a latch circuit, a shift register, an analog switch, etc. (not shown) in like manner of a prior art.

Figure 2:
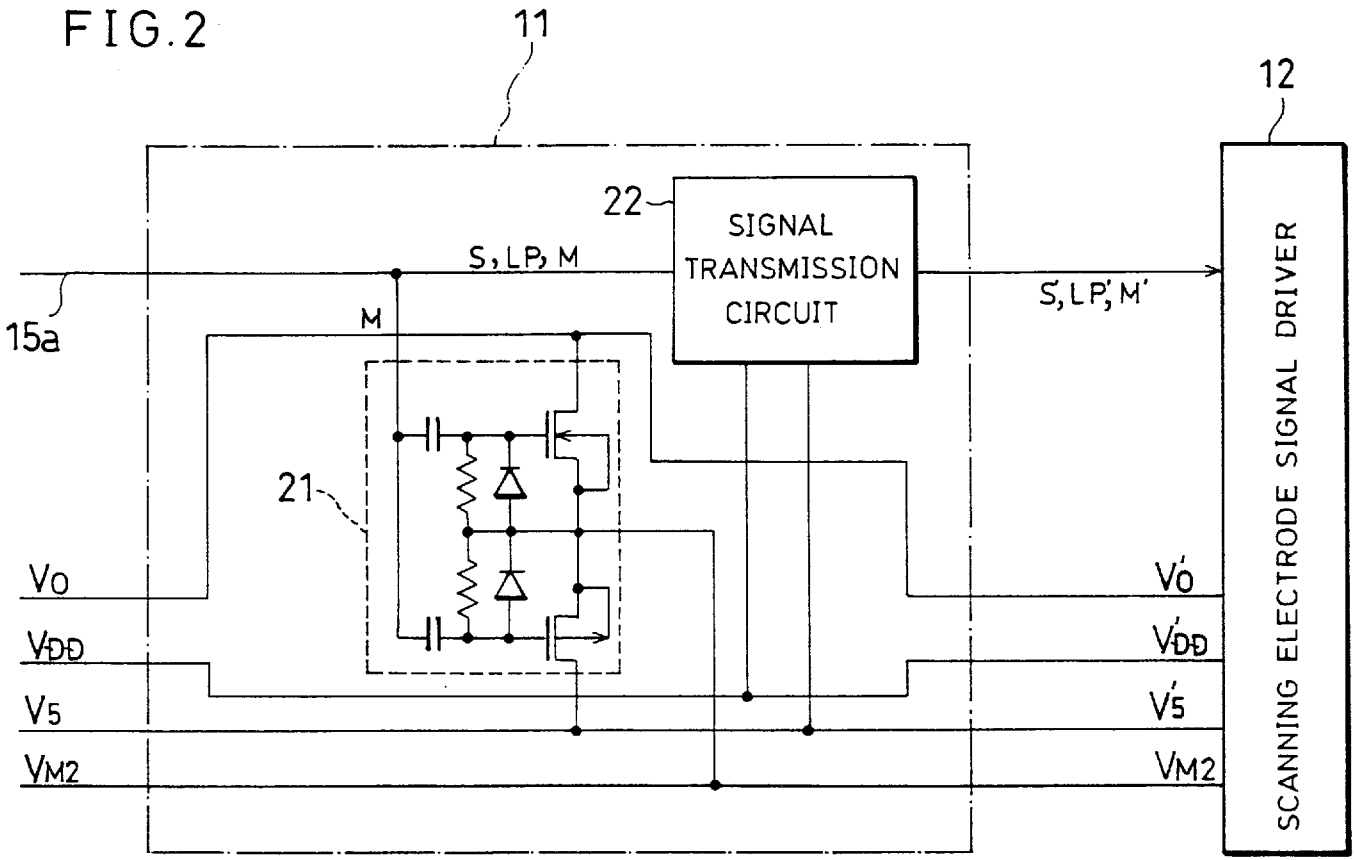
FIG. 2 is an constitutional drawing of a voltage switching circuit on a scanning electrode signal driver side in the liquid crystal display device shown in FIG. 1.

As shown in FIG. 2, the voltage switching circuit 11 of the present embodiment is provided with a switching circuit 21 for transmitting liquid crystal driving voltages V0' and V5' to the scanning electrode signal driver 12, and a signal transmitting circuit 22 for transmitting the control signal 15*a* to the scanning electrode signal driver 12.

Figures 3A, 3B, 3C, 3D:
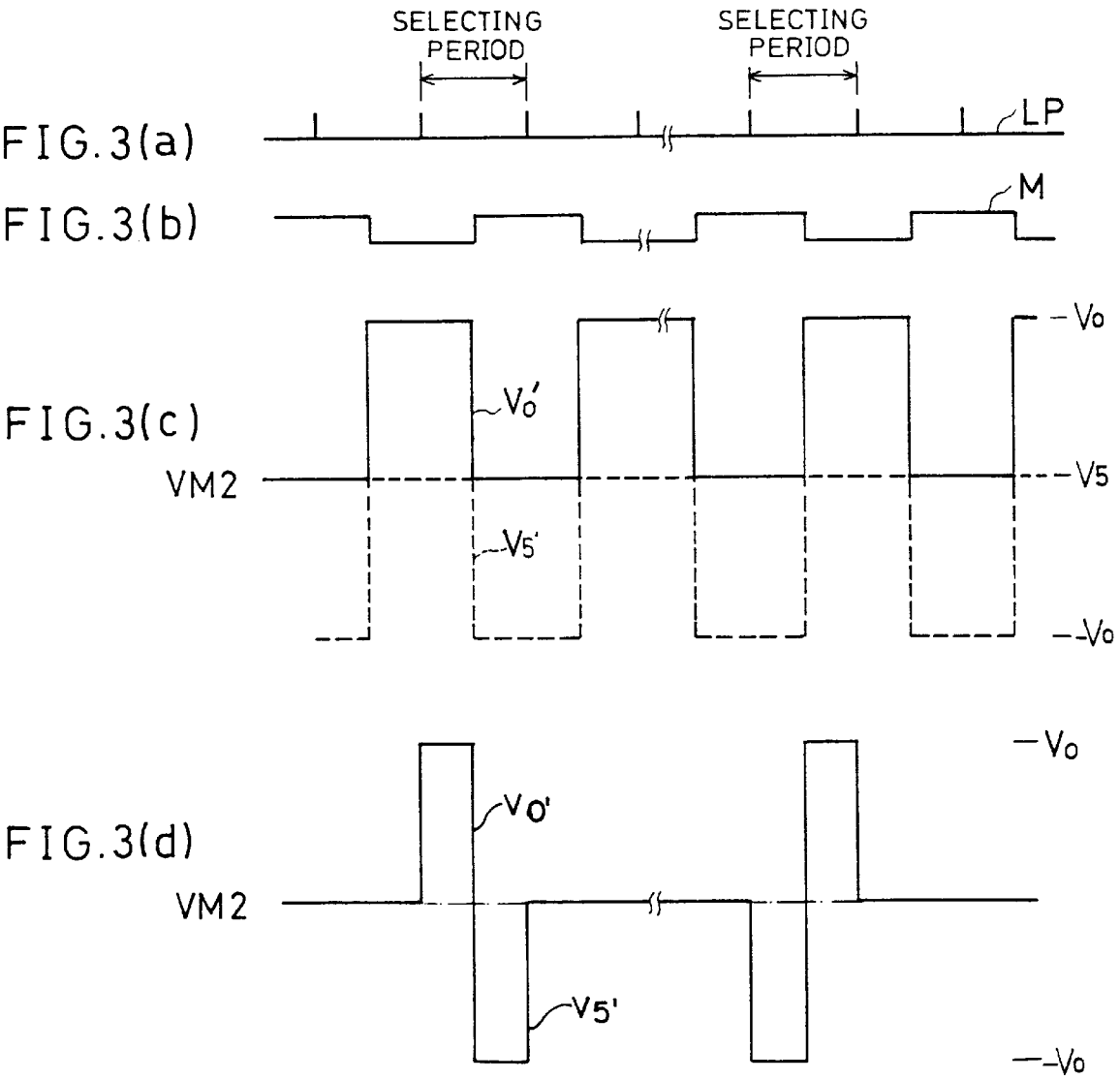
FIGS. 3(*a*) through 3(*d*) are waveform charts which show the operation of the voltage switching circuit on the scanning electrode signal driver side shown in FIG. 2.
Figures 13A, 13B, 13C, 13D, 13E:
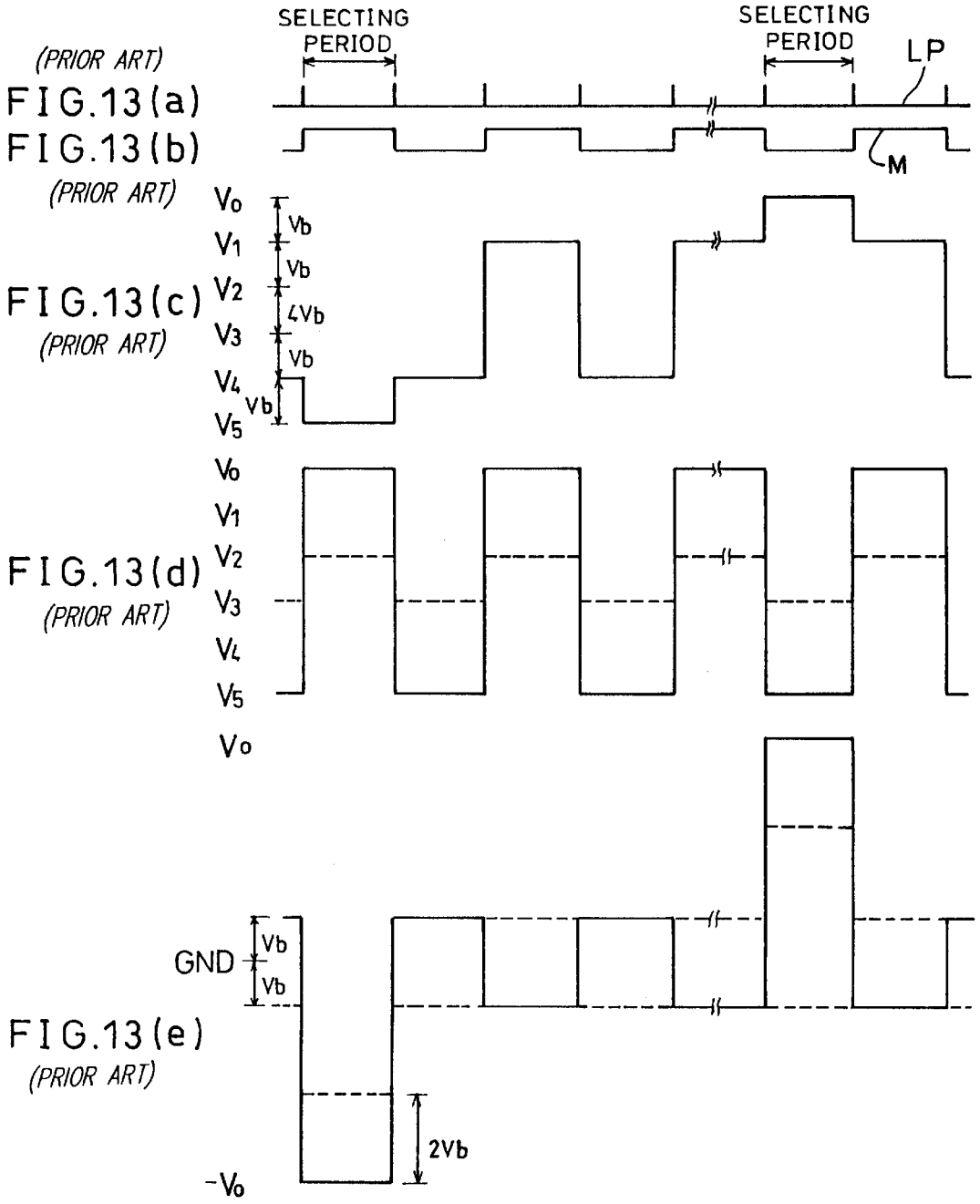
(PRIOR ART) FIG.13(a)
FIG.13(b) (PRIOR ART)
FIG.13(c) (PRIOR ART)
FIG.13(d) (PRIOR ART)
FIG.13(e) (PRIOR ART)
FIGS. 13(*a*) through 13(*e*) are waveform charts which shows an operation of the liquid crystal display device of FIG. 11.
Figure 14:
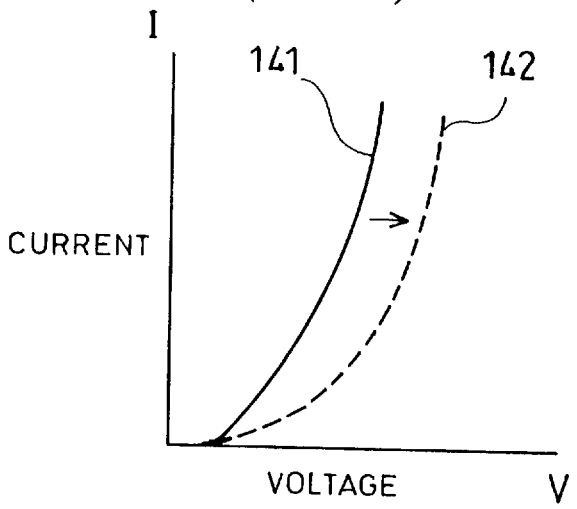
FIG.14 (PRIOR ART)
FIG. 14 is a graph which shows I-V characteristic of a two-terminal non-linear element.
Figure 15:
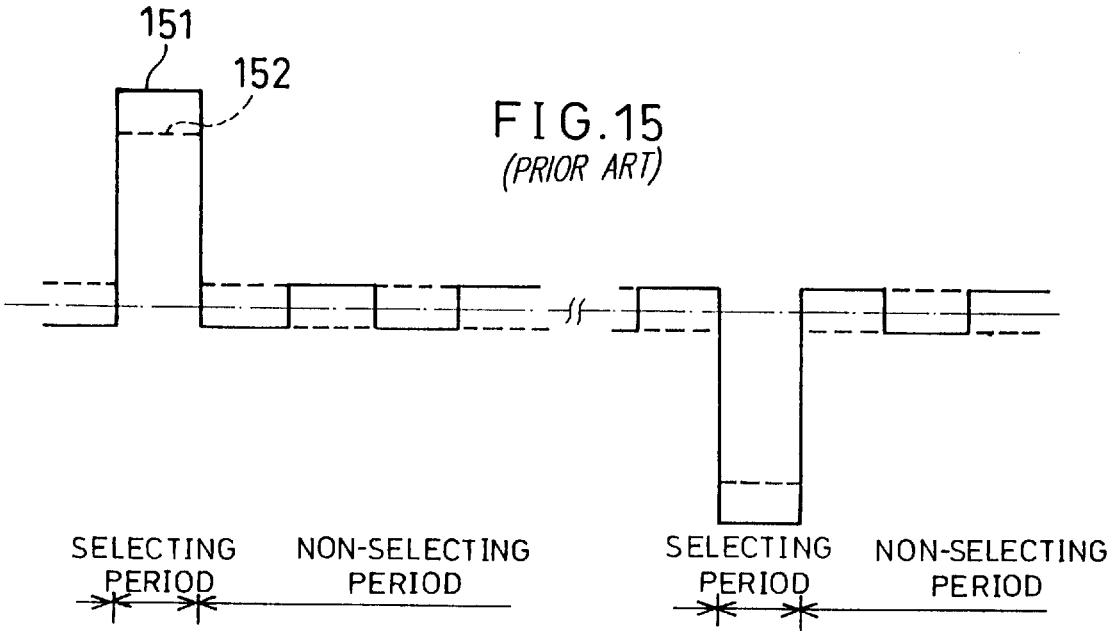
FIG.15 (PRIOR ART)
FIG. 15 is a waveform chart which shows the case where an active-matrix-type liquid crystal display device using the two-terminal non-linear element is driven by the voltage averaging method.
Figure 16A:
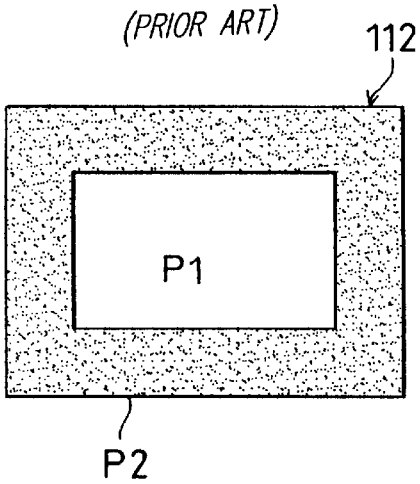
FIG.16(a) (PRIOR ART)
FIGS. 16(*a*) and 16(*b*) are explanatory drawings of a residual image phenomenon in a liquid crystal display device which is in normally-white mode.
Figure 16B:
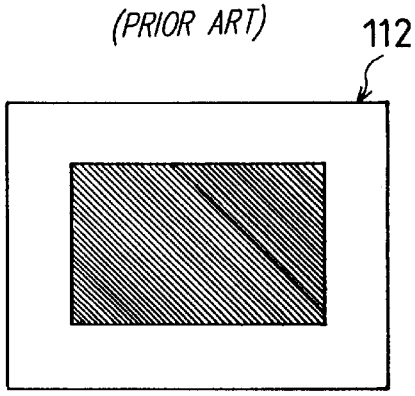
FIG.16(b) (PRIOR ART)
Figure 17:
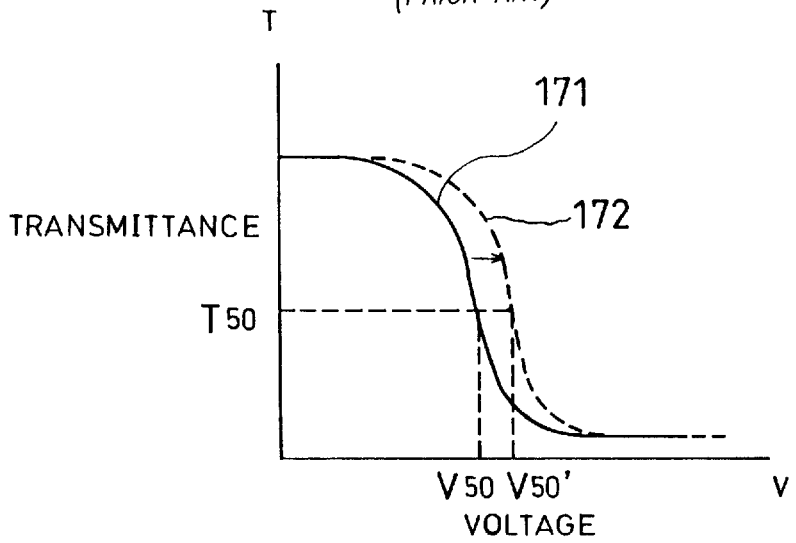
FIG.17 (PRIOR ART)
FIG. 17 is a graph which shows T-V (transmittance-voltage) characteristic of the liquid crystal element.
Figure 18:
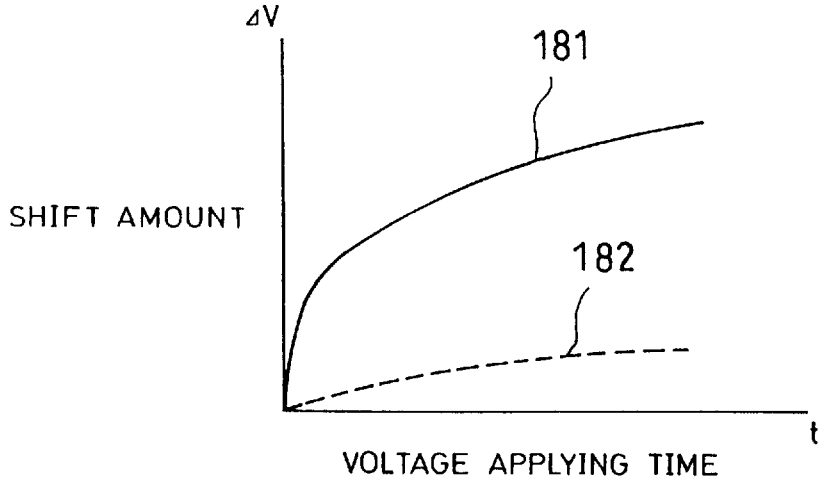
FIG.18 (PRIOR ART)
FIG. 18 is a graph which shows a result of plotting a shift amount of the voltage, at which transmittance becomes 50%, against the voltage applying time.
Figures 19A, 19B, 19C, 19D, 19E:
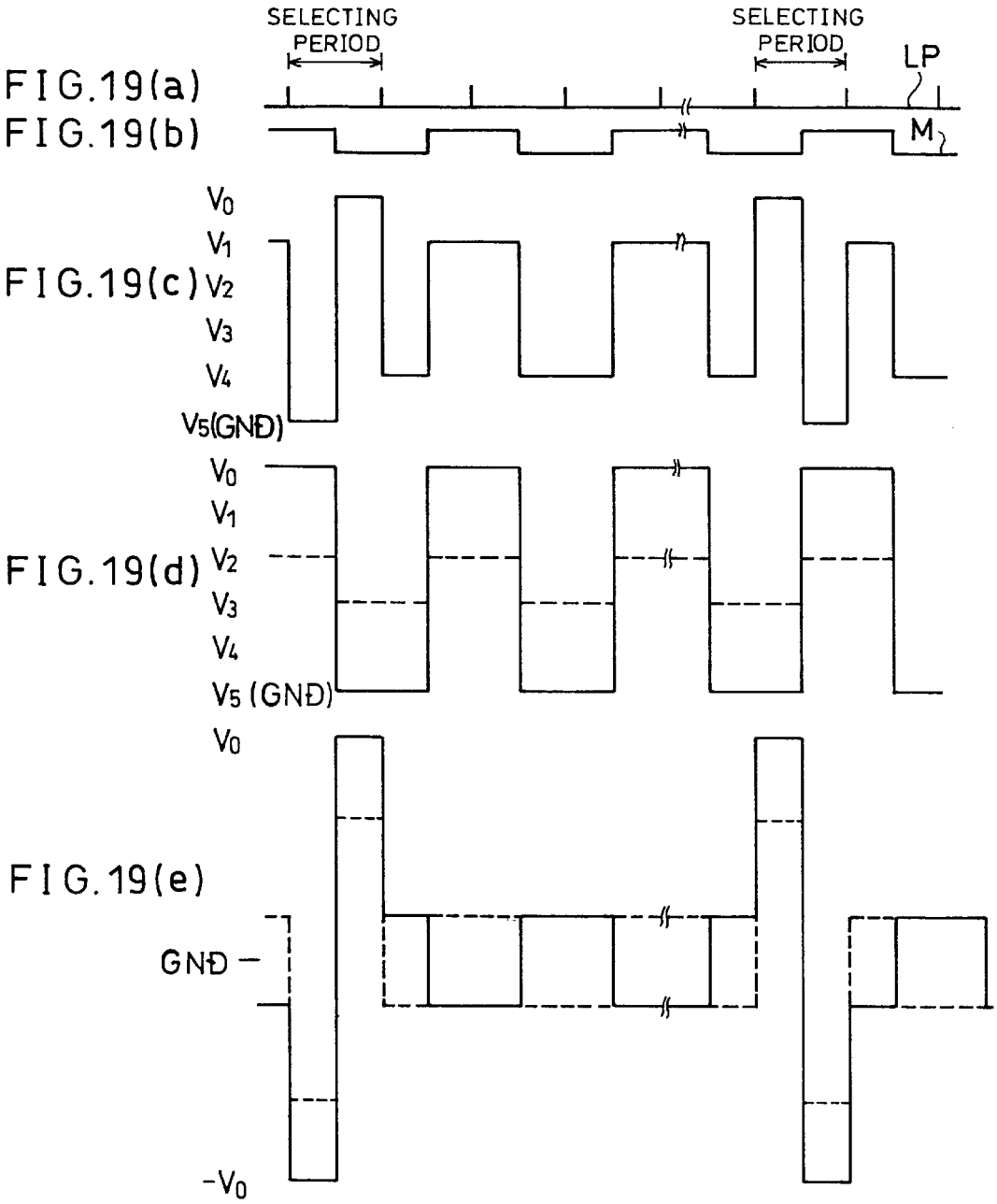
FIGS. 19(*a*) through 19(*e*) are waveform charts in the case where the active-matrix-type liquid crystal display device using the two-terminal non-linear element is driven by the voltage averaging method and different voltages are applied for the first half of selecting period and for the latter half of selecting period.

The switching circuit 21 switches the levels of liquid crystal driving voltages V0 and V5 out of 6-level liquid crystal driving voltages V0 through V5 to be used in the conventional voltage averaging method (see FIGS. 13 and 19 showing prior art) according to the switching signal M. In other words, as shown in FIG. 3(*b*), while the level of the switching signal M is high, the switching circuit 21 switches the level of the liquid crystal driving voltage V0 to VM2 (reference level) as shown in FIG. 3(*c*). Moreover, while the level of the switching signal M is low, the level of the liquid crystal driving voltage V5 is switched to VM2. Here, VM2 is a voltage which is half of VM1, and VM1 is a high-level voltage of a data electrode signal as mentioned later.

The switching circuit 21 is composed of, for example, two capacitors, two resistors, two diodes, P-FET (P-channel field effect transistor), and N-FET (N-channel field effect transistor) (FIG. 2).

The levels of the other liquid crystal driving voltages V1 through V4 are fixed to VM2.

In accordance with the above arrangement, the scanning electrode signal driver 12 outputs a scanning electrode signal shown in FIG. 3(*d*). In other words, during the selecting period and while the level of the switching signal M is lower, the liquid crystal driving voltage V0' (a scanning electrode signal whose level is higher than the reference level) is outputted, and during the selecting period and while the level of the switching signal M is higher, the liquid crystal driving voltage V5' (a scanning electrode signal whose level is lower than the reference level) is outputted. During a non-selecting period, VM2 is outputted regardless of the level of the switching signal M.

Figures 4A, 4B, 4C, 4D, 4E:
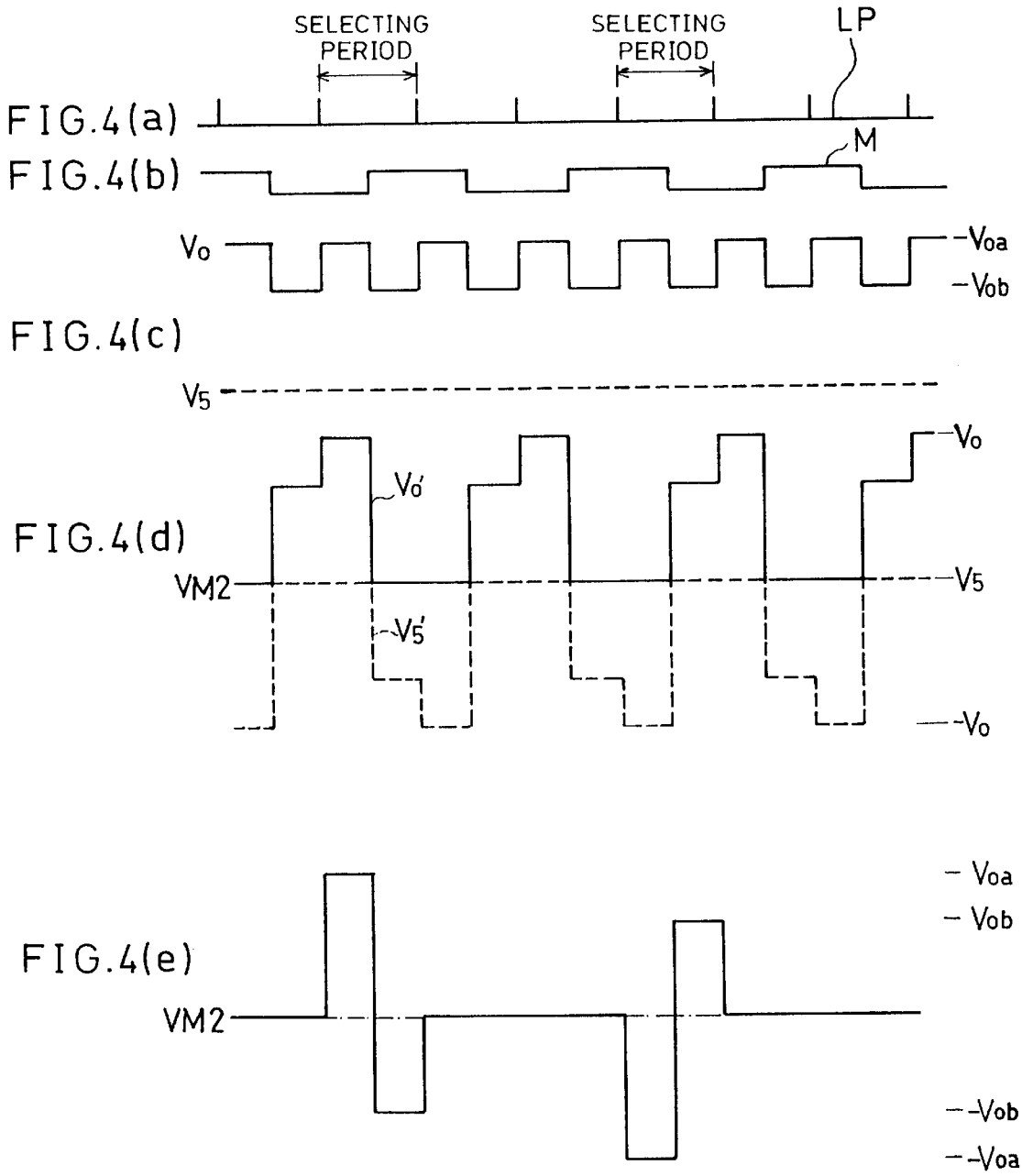
FIGS. 4(*a*) through 4(*e*) are waveform charts which shows the operation of the voltage switching circuit on the scanning electrode signal driver side in the case where a liquid crystal driving voltage whose level is changed is used.

In the voltage switching circuit 11, the level of the original liquid crystal driving voltage V0 is constant, but a liquid crystal driving voltage V0, whose level is switched according to the latch pulse and the switching signal, can be used. As shown in FIG. 4(*c*), for example, a liquid crystal driving voltage V0, whose level is switched to V0a per latch pulse and is switched to V0b every time the level of the switching signal M is switched, can be used.

In this case, the switching circuit 21 transmits the liquid crystal driving voltages V0' and V5' having waveforms in FIG. 4(*d*) to the scanning electrode signal driver 12.

Therefore, as shown in FIG. 4(*e*), the scanning electrode signal driver 12 outputs V0a (or −V0a) during the first half of the selecting period, and outputs V0b (or −V0b) during the latter half of the selecting period. In other words, when the liquid crystal driving voltage V0 whose level is switched to V0a and V0b is used, the scanning electrode signals, whose levels are different during the first half of the selecting period and during the latter half of the selecting period, can be outputted.

Figure 5:
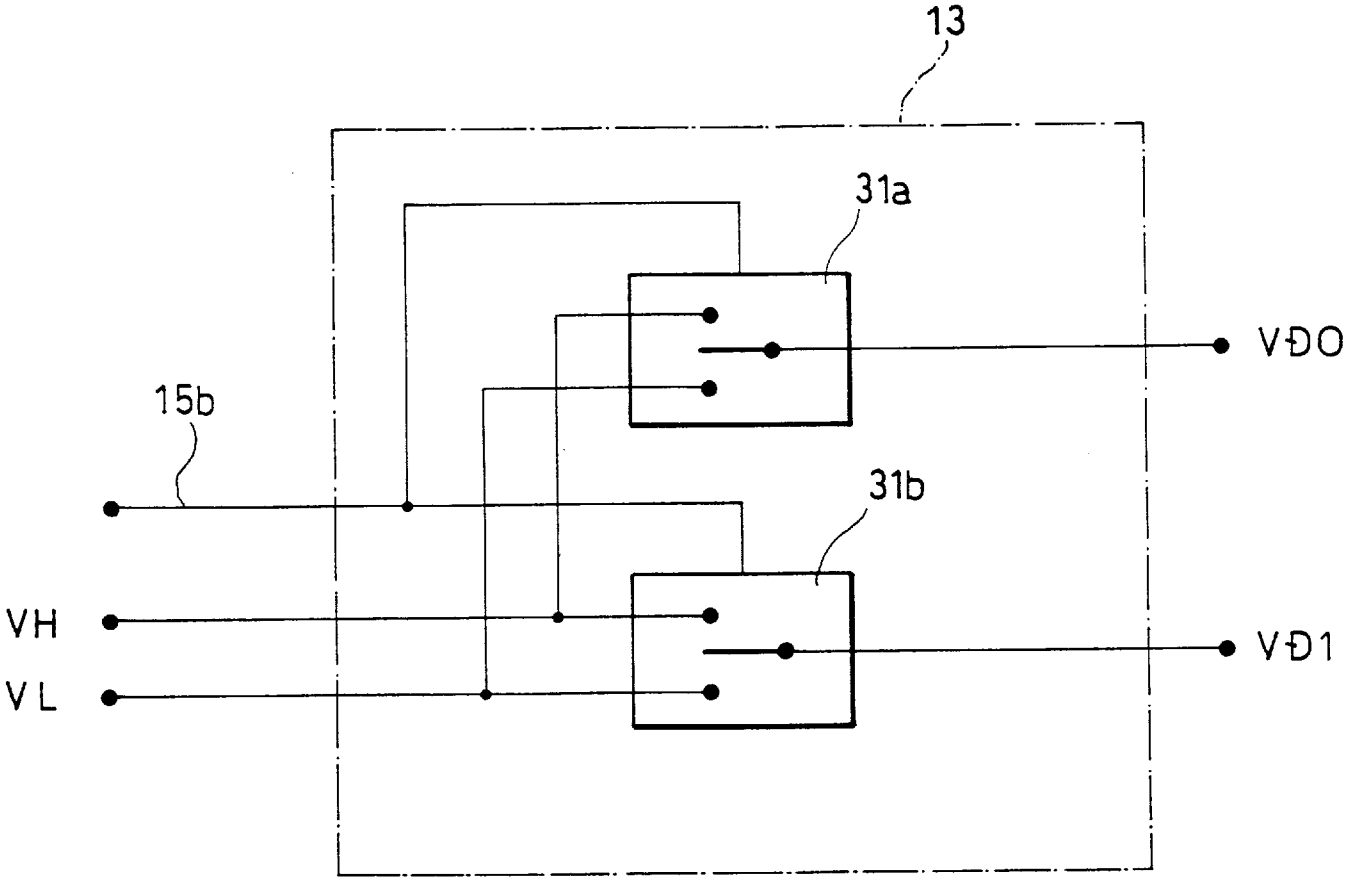
FIG. 5 is a constitutional drawing of a voltage switching circuit on a data electrode signal driver side in the liquid crystal display device shown in FIG. 1.

As shown in FIG. 5, the voltage switching circuit 13 of the present embodiment is provided with a switching circuit 31*a* for transmitting a liquid crystal driving voltage VD0 to the data electrode signal driver 14, and a switching circuit 31*b* for transmitting a liquid crystal driving voltage VD1 to the data electrode signal driver 14. Here, the liquid crystal driving voltage VD0 is a voltage for turning off the liquid crystal element of the display panel 10, and the liquid crystal driving voltage VD1 is a voltage for turning on the liquid crystal element of the display panel 10.

Figures 6A, 6B, 6C, 6D, 6E:
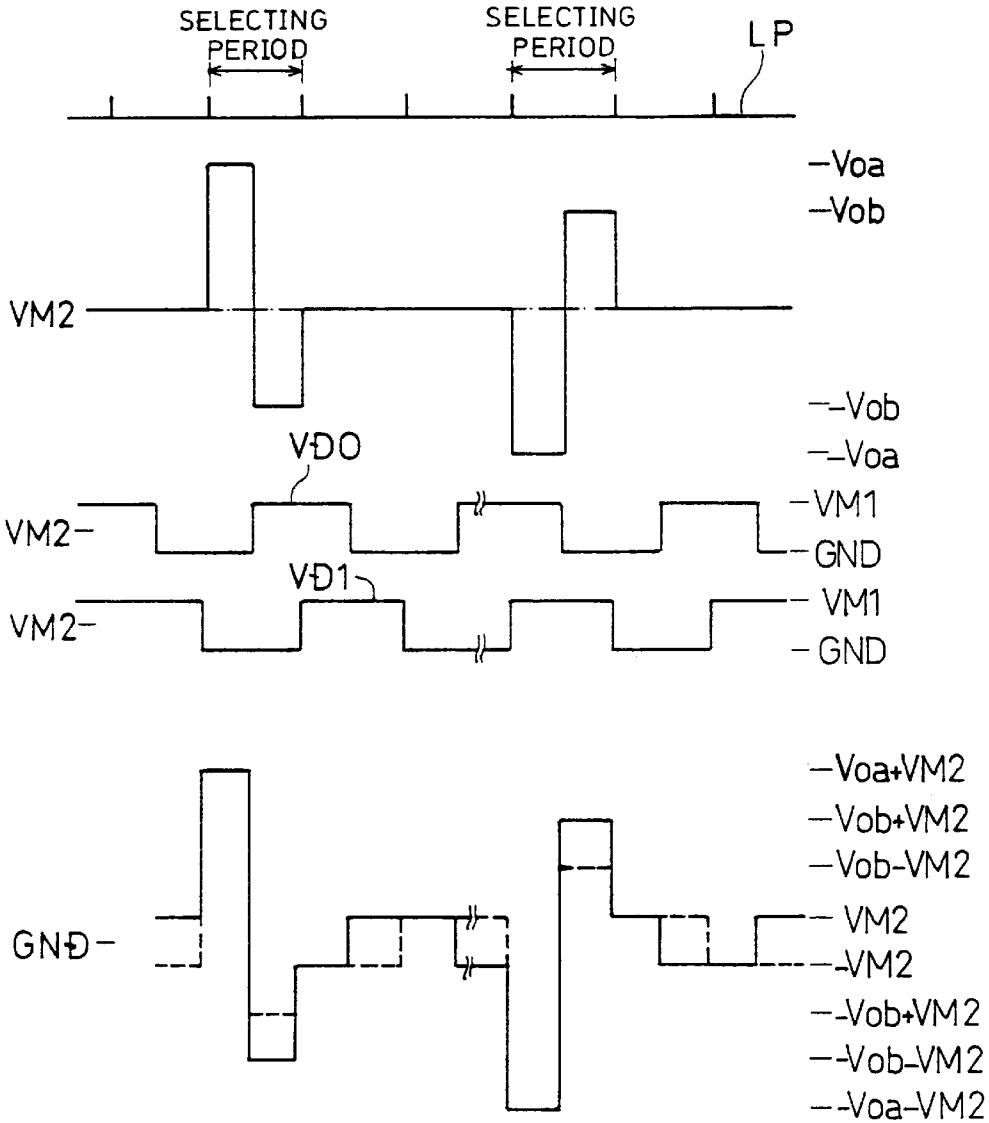
FIGS. 6(*a*) through 6(*e*) are waveform charts which show an operation of the voltage switching circuit on the data electrode signal driver side of FIG. 5.

The switching circuit 31*b* selects one of liquid crystal driving voltages VH and VL according to the control signal 15*b* and outputs it as the liquid crystal driving voltage VD1. In other words, as shown in FIG. 6(*d*), the liquid crystal driving voltages VH and VL are alternately selected so as to be outputted per latch pulse. Here, the levels of the liquid crystal driving voltages VH and VL are respectively equal to VM1 and GND (ground level).

The switching circuit 31*a* selects one of the liquid crystal driving voltages VH and VL according to the control signal 15*b*, and as shown in FIG. 6(*c*), outputs it as the liquid crystal driving voltage VD0.

Figure 7:
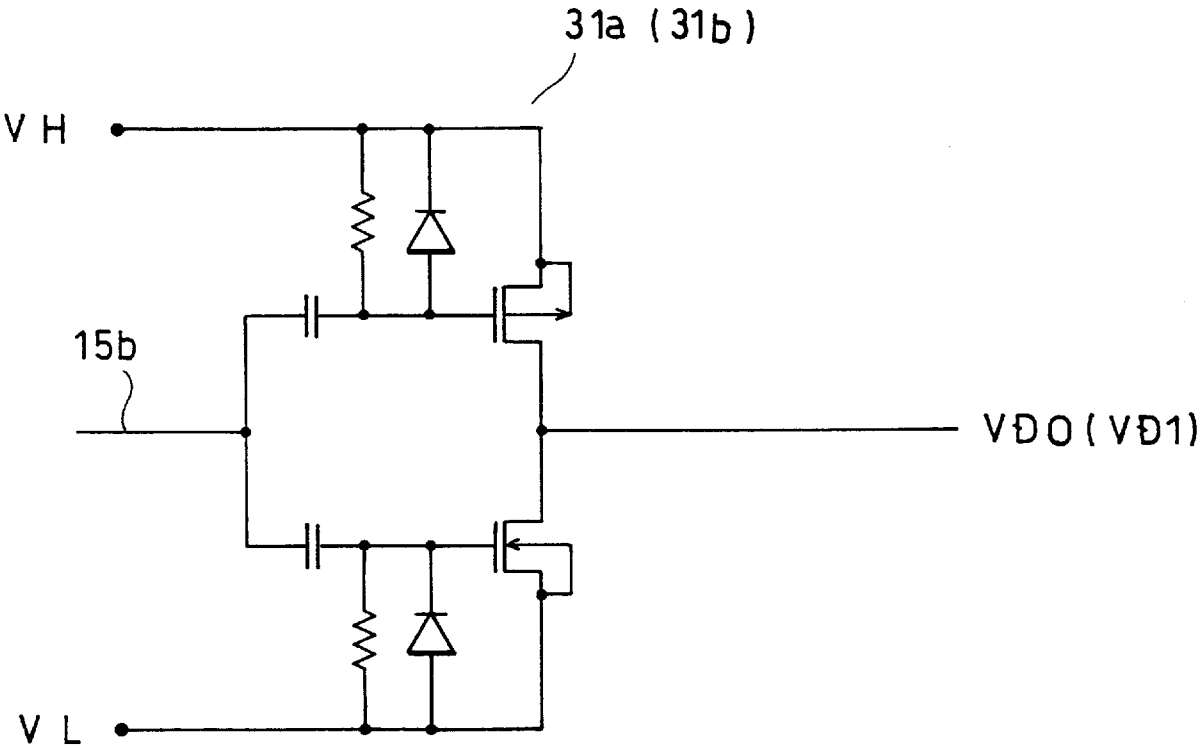
FIG. 7 is a circuit diagram which shows one example of a switching circuit to be used in the voltage switching circuit of FIG. 5.

As shown in FIG. 7, the switching circuit 31*a* (31*b*) is composed of, for example, two capacitors, two resistors, two diodes, P-FET (P-channel field effect transistor) and N-FET (N-channel field effect transistor).

The data electrode signal driver 14 selects one of the liquid crystal driving voltages VD0 and VD1 according to display information, and outputs it as a data electrode signal. In other words, in the case where the liquid crystal element is turned on, the data electrode signal driver 14 outputs the liquid crystal driving voltage VD1, and in the case where the liquid crystal element is turned off, outputs the liquid crystal driving voltage VD0.

Therefore, in the case where the liquid crystal element of the display panel 10 is turned off, a differential voltage (represented by a solid line in FIG. 6(*e*)) between the voltage of the scanning electrode signal in FIG. 6(*b*) and the voltage of the liquid crystal driving VDO in FIG. 6(*c*) is applied to the picture element. A charge, which was supplied to the liquid crystal element during the first half of the selecting period, is cleared during the latter half of the selecting period, so the liquid crystal element is in OFF state.

In the case where the liquid crystal element of the display panel 10 is turned on, a voltage difference (represented by a dotted line in FIG. 6(*e*)) between the voltage of the scanning electrode signal in FIG. 6(*b*) and the voltage of the liquid crystal driving VD1 in FIG. 6(*d*) is applied to the picture element. A charge, which was supplied to the liquid crystal element during the first half of the selecting period, is not cleared during the latter half of the selecting period, so the liquid crystal element is in ON state. This is because the level of the voltage applied during the latter half of the selecting period is lower than the level of the voltage applied to the first half of the selecting period.

In the present embodiment, the voltage to be applied to the picture element during the selecting or non-selecting period can be freely controlled by adjusting the level of the liquid crystal driving voltage V0 (or the levels of V0a and V0b). Therefore, it is possible to make the shift amount of the I-V characteristic of the two-terminal non-linear element connected to the liquid crystal element in ON state approximately equal to the shift amount of the I-V characteristic of the two-terminal non-linear element connected to the liquid crystal element in OFF state. As a result, production of a residual image and burning due to the shift of the I-V characteristic can be greatly decreased.

In addition, the level of the voltage to be applied to the liquid crystal element in OFF state can be lowered by adjusting an applied voltage during writing/erasing period (namely, the latter half of the selecting period). Therefore, high contrast can be realized, and moreover, a voltage range (operation margin), which can provide contrast with a value of not less than a predetermined value, can be widen.

In addition, the polarity of the scanning electrode signal is switched during the selecting period, and the level of the scanning electrode signal is made constant during the non-selecting period. Accordingly, the polarity of the scanning electrode signal is not switched during the non-selecting period, and the level of the data electrode signal can be lowered. As a result, the fluctuation in the voltage to be applied to the picture element during the non-selecting period can be small, so occurrence of crosstalk can be lowered.

Figures 8A, 8B, 8C, 8D:
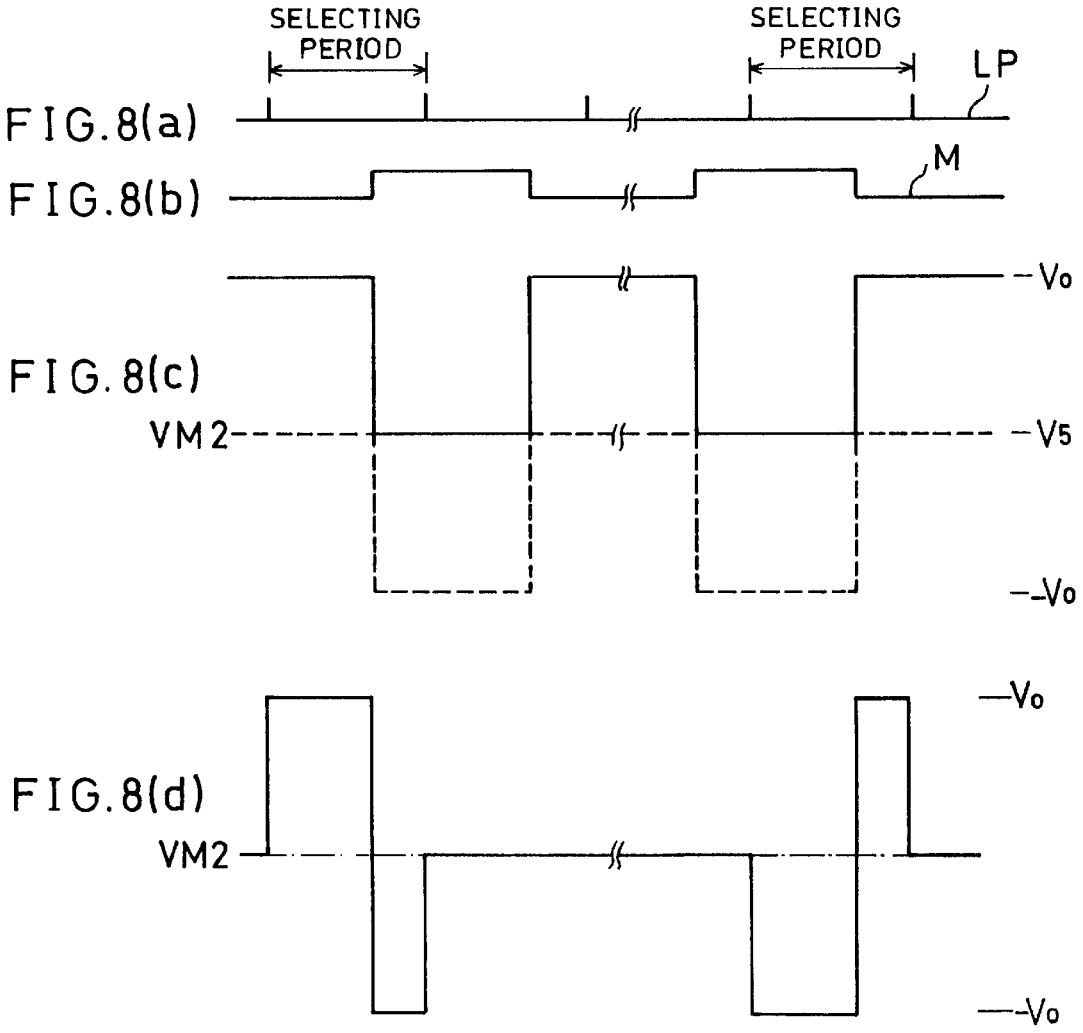
FIGS. 8(*a*) through 8(*d*) are waveform charts which show the operation of the voltage switching circuit on the scanning electrode signal driver side in the case where selecting period is divided into three.
Figures 9A, 9B, 9C, 9D, 9E:
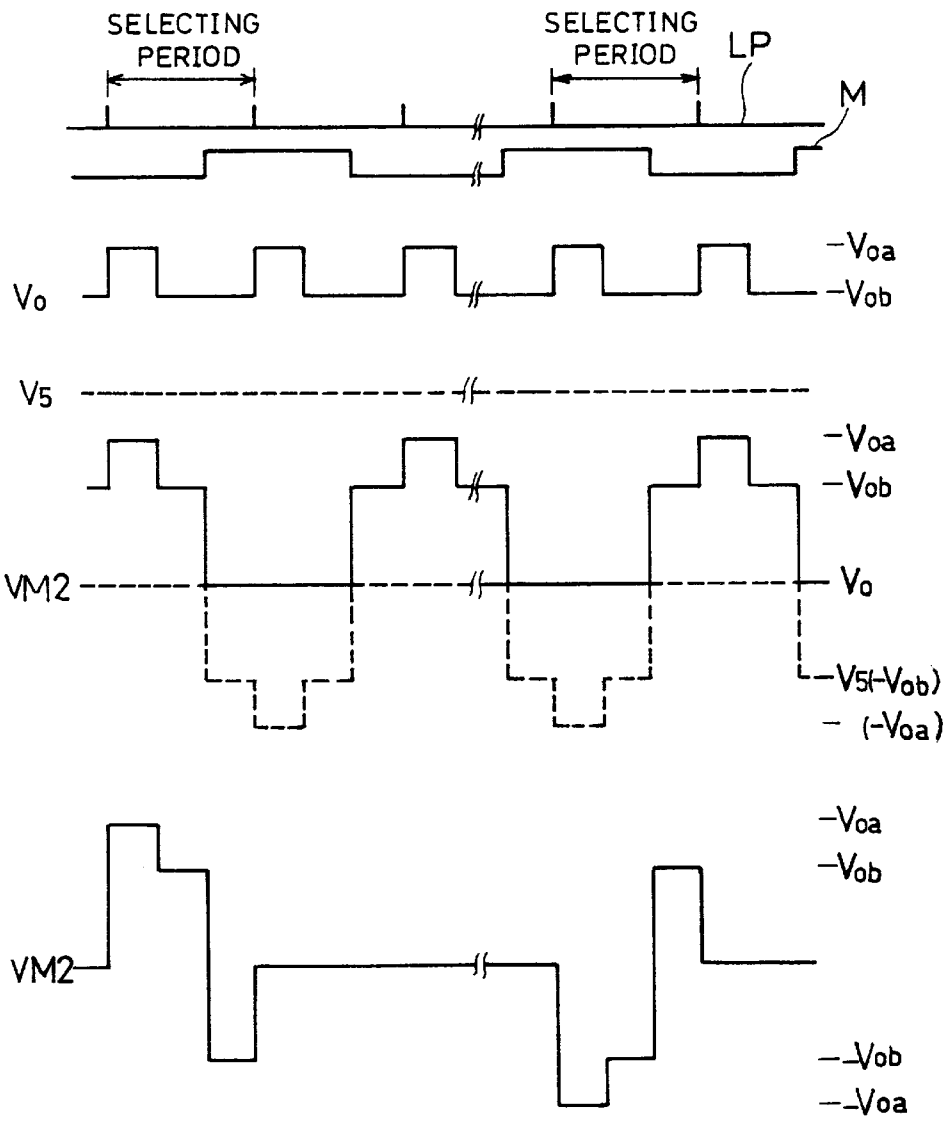
FIGS. 9(*a*) through 9(*e*) are waveform charts which show the operation of the voltage switching circuit on the scanning electrode signal driver side in the case where selecting period is divided into three and a liquid crystal driving voltage whose level is changeable is used.

In the above embodiment, the selecting period is divided into two (namely, in FIG. 6(*e*), the width of the pulse to be applied during the first half of the selecting period is equal to a width of the pulse to be applied during the latter half of the selecting period), but as shown in FIG. 8, the ratio of a pulse width can be changed. Moreover, as shown in FIG. 9, the selecting period is divided into three and the liquid crystal driving voltage V0, whose level is switched according to the latch pulse and the switching signal, can be used. In other words, as shown in FIG. 9(*c*), the liquid crystal driving voltage V0, whose level is switched to v0a per latch pulse and is switched to V0b every time the level of the switching signal is switched, can be used. As a result, as shown in FIG. 9(*e*), the level of the driving voltage to be applied to the picture element can be varied at the first third, middle third and last third of the selecting times. Similarly, the selecting period can be divided into four or more, and the level of the driving voltage can be changed at each divided selecting period.

Figure 10B:
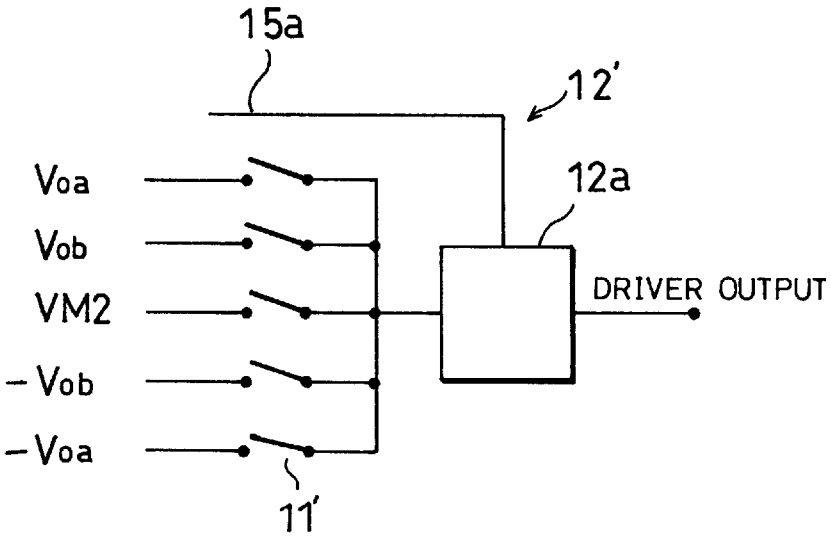
FIGS. 10(*a*) and 10(*b*) are block diagrams which show the scanning electrode signal driver provided with the voltage switching circuit.
Figure 10A:
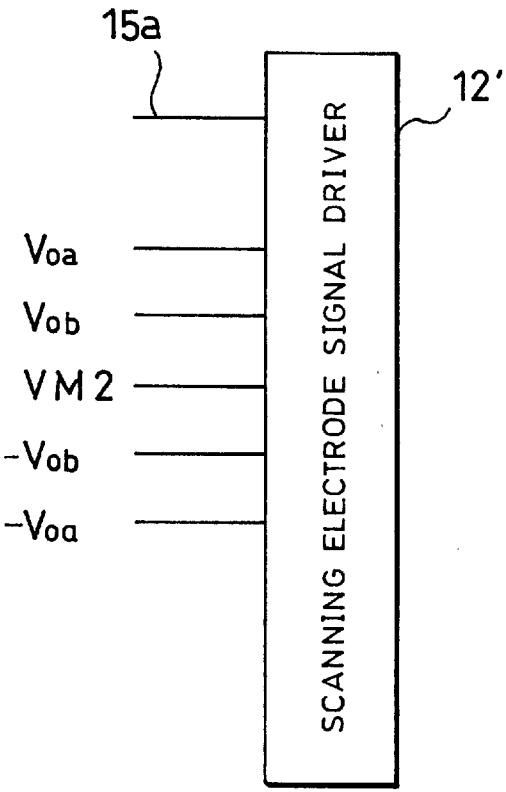
Figure 11:
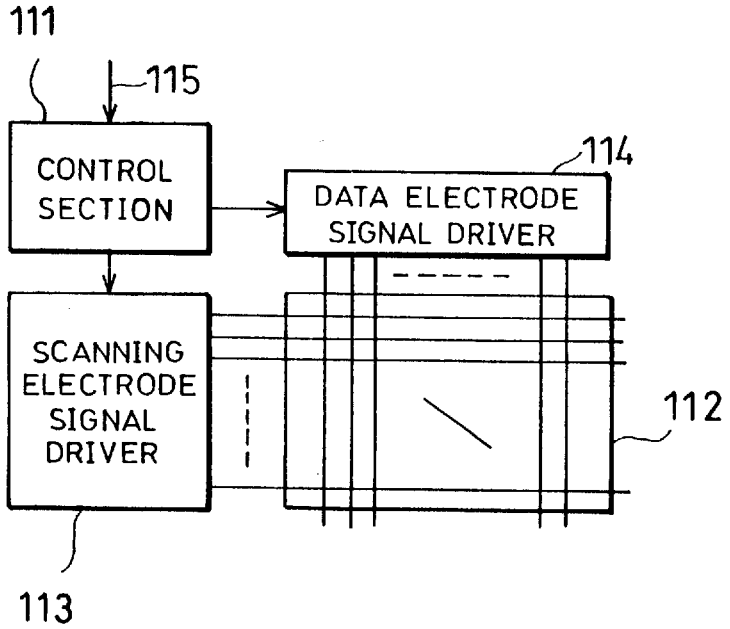
FIG.11 (PRIOR ART)
FIG. 11 is a block diagram which shows a schematic arrangement of a conventional liquid crystal display device.

In addition, in the present embodiment, the liquid crystal driving voltage can be switched between V0 and V5 by using the voltage switching circuit 11, which is provided outside the scanning electrode signal driver 12, but a scanning electrode signal driver 12' including the voltage switching circuit 11 may be also used. In this case, as shown in FIG. 10(*a*), for example, the voltages V0a, V0b, VM2, −V0b and −V0a are inputted to the driver 12', and as shown in FIG. 10(*b*), these voltages are switched by a voltage switching circuit 11' provided in the driver 12'. Then, the scanning electrode signal is outputted from a driver main body 12*a* according to the voltages from the voltage switching circuit 11' so that the same scanning electrode signal as in FIG. 4(*e*) can be obtained.

In addition, the switching circuit 31*a* and 31*b* of the voltage switching circuit 13 select one of the liquid crystal driving voltages VH and VL according to the control signal 15*b* so as to output it. However, the liquid crystal voltage between VH and VL is divided into a plurality of levels (not less than 3 levels), and one of the levels is selected so as to be outputted. As a result, tone display can be realized.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for driving an active matrix liquid crystal display device, in which a scanning electrode signal and a data electrode signal are successively applied to a display panel where picture elements, which are arranged so that a liquid crystal element and a two-terminal non-linear element are connected in series, are arranged in a matrix-like pattern so that the display panel is driven by a voltage averaging method, said method for driving the active matrix liquid crystal display device, comprising the steps of:

applying a scanning electrode signal whose level is switched between lower and higher levels than a reference level during each single selecting period, said selecting period being a period for determining whether the picture element is turned on or off; and applying a scanning electrode signal with the reference level during a non-selecting period, wherein the data electrode signal is switched among not less than three levels according to display information.

2. A method for driving an active matrix liquid crystal display device, in which a scanning electrode signal and a data electrode signal are successively applied to a display panel where picture elements, which are arranged so that a liquid crystal element and a two-terminal non-linear element are connected in series, are arranged in a matrix-like pattern so that the display panel is driven by a voltage averaging method, said method for driving the active matrix liquid crystal display device, comprising the steps of:

applying a scanning electrode signal whose level is switched between lower and higher levels than a reference level during each single selecting period, said selecting period being a period for determining whether the picture element is turned on or off; and applying a scanning electrode signal with the reference level during a non-selecting period, wherein the data electrode signal is a signal which has a period twice the length of the selecting period and whose level is alternatively switched between the two levels, and the picture element is turned on/off by shifting a phase of the data electrode signal by a half length of the selecting period.

3. A liquid crystal display device, comprising:

a display panel where picture elements, which are arranged so that a liquid crystal element and a two-terminal non-linear element are connected in series, are arranged in a matrix-like pattern;

voltage generating means for generating driving signals V0 through V5;

first switching means for converting the driving signal V0 into a driving signal V0' whose level is switched to a higher level than a reference level and to the reference level per a first period which is equal to the length of a selecting period for determining as to whether the picture element is turning on or off and is not synchronized with the selecting period, and for converting the driving signal V5 into a driving signal V5' whose level is switched to a lower level than the reference level and to the reference level per the first period;

converting means for converting the driving signals V1 through V4 into driving signals V1' through V4' having the same level as the reference level; and a scanning electrode signal driver for applying to a scanning electrode of the picture element a scanning electrode signal whose level is switched between a higher level than the reference level and a lower level than the reference level during a single selecting period, and applying a scanning electrode signal of the reference level to the scanning electrode of the picture element during the non-selecting period, the higher level corresponding to the driving signal V0', the lower level corresponding to the driving signal V5', the reference level corresponding to the driving signal signals V1' through V4'.

4. The liquid crystal display device as defined in claim 3, wherein said voltage generating means generates the driving signals V0 and V5 whose levels are constant.

5. The liquid crystal display device as defined in claim 3, wherein said voltage generating means generates the driving signal V0 or V5 which has the same cycle as the selecting period and whose level is alternatively switched between two levels.

6. The liquid crystal display device as defined in claim 3, further comprising:

second switching means; and a signal electrode signal driver for driving a signal electrode of the picture element, wherein said voltage generating means further generates driving signals VH and VL, wherein said second switching means outputs an ON-signal which has a period twice the selecting period and whose level is alternatively switched between two levels and an OFF-signal having a phase which is shifted from a phase of the ON-signal by a half time of the selecting period based upon the driving signals VH and VL, wherein said signal electrode signal driver drives the signal electrode of the picture element based upon data electrode signals composed of the ON-signal and the OFF-signal.

7. The liquid crystal display device as defined in claim 6, wherein the reference level is set to a center level between the two levels of the ON-signal.

* * * * *